United States Patent [19]

Dietiker et al.

[11] Patent Number: 4,790,352

[45] Date of Patent: Dec. 13, 1988

[54] SLOW OPENING AND FAST CLOSURE GAS VALVE

[75] Inventors: Paul Dietiker, Redondo Beach; Frederick W. Johnson, Torrance, both of Calif.

[73] Assignee: Honeywell Inc., Minneapolis, Minn.

[21] Appl. No.: 82,457

[22] Filed: Aug. 7, 1987

[51] Int. Cl.[4] ..... F16K 31/42

[52] U.S. Cl. ..... 137/613; 137/510; 251/30.02

[58] Field of Search ..... 137/489, 510, 613; 251/30.02

[56] References Cited

U.S. PATENT DOCUMENTS

| | | | |
|---|---|---|---|
| 3,090,592 | 5/1963 | Fleer | 251/30.05 |
| 3,300,174 | 1/1967 | Urban et al. | 251/29 |
| 3,304,002 | 2/1967 | Grayson | 137/489 X |
| 3,447,775 | 6/1969 | Katchka et al. | 137/489 X |
| 3,525,355 | 8/1970 | Katchka | 137/489 |
| 3,526,360 | 9/1970 | Ray | 137/489 X |
| 4,254,796 | 3/1981 | Kelly | 137/489 |

*Primary Examiner*—A. Michael Chambers
*Assistant Examiner*—John C. Fox
*Attorney, Agent, or Firm*—Mitchell J. Halista; Albin Medved; Clyde C. Blinn

[57] ABSTRACT

A slow opening and fast closing gas valve includes a valve seat and a valve closure member arranged to respond to a gas pressure to seal aganst the valve seat to close the valve to an input gas flow therethrough. In order to open the valve, the gas exerting the gas pressure for sealing the valve closure member against the valve seat is allowed to bleed-off through a fixed restriction while the input gas is allowed to urge the valve closure member away from the valve seat to provide a slow opening of the input gas flow path through the valve. In order to close the input gas path through the valve, the input gas pressure is applied to the valve closure member to assist a closure spring in urging the valve closure member against the valve seat to produce a fast closure of the valve. A second valve is arranged to selectively control the flow path of the gas being bled off from the valve closure member to provide an unrestricted flow path or a restricted flow path through the fixed restriction. The restricted flow path is used during the opening of the gas valve while the unrestricted flow path is used during a closing of the gas valve.

5 Claims, 3 Drawing Sheets

SLOW OPENING AND FAST CLOSURE GAS VALVE

BACKGROUND OF THE INVENTION

Field of the Invention

The present invention relates to fluid pressure operated gas valves. More specifically, the present invention is directed to a gas valve having separately characterized opening and closing operations.

SUMMARY OF THE INVENTION

An object of the present invention is to provide an improved gas valve having separately characterized opening and closing operations.

In accomplishing this and other objects, there has been provided, in accordance with the present invention a gas valve having a valve seat and a valve closure member, first flow path means for rapidly admitting a pressurized gas to urge the valve closure member against the valve seat, a second gas flow path means having a fixed flow restriction and control means for selectively blocking the operation of the first means and introducing the second gas flow means as an exit path for the pressurized gas through the fixed restriction to interrupt the urging of the valve closure member against the valve seat by the pressurized gas by allowing the pressurized gas to slowly exit through the fixed restriction.

BRIEF DESCRIPTION OF THE DRAWINGS

A better understanding of the present invention may be had when the following detailed description is read in connection with the accompanying drawings in which.

DESCRIPTION OF THE PREFERRED EMBODIMENT

Figure 1:
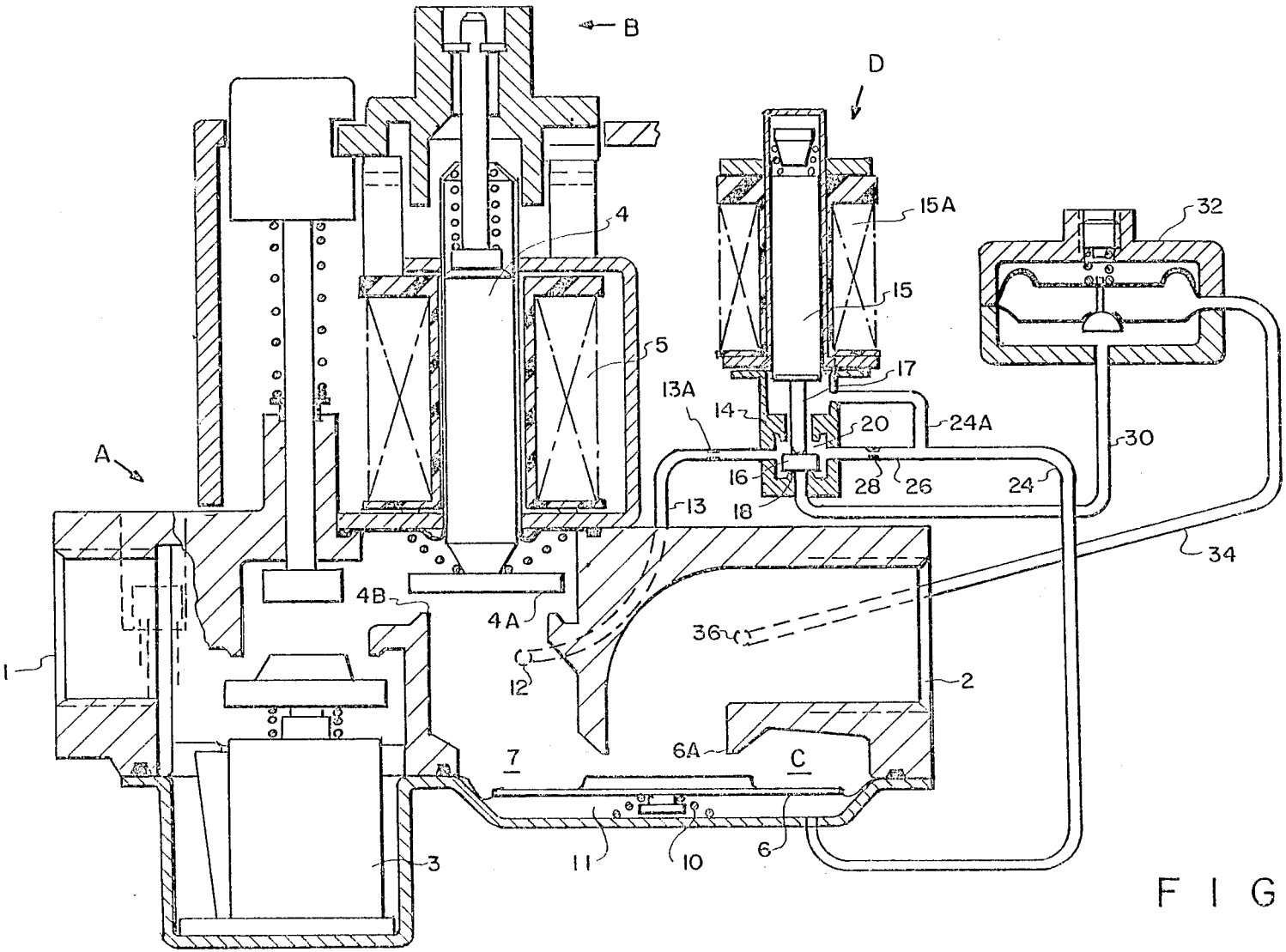
FIG. 1 is a cross-sectional illustration of a first embodiment of a gas valve using the present invention.

Referring to FIG. 1 in more detail, there is shown a gas valve structure A having an inlet 1 and an outlet 2. A safety valve device 3 using a thermocouple is located in the gas flow path within the valve A. A first electromagnetic control valve B having an armature 4, a valve closure member 4A mounted on the armature 4, a valve seat 4B facing the closure member 4A and a solenoid winding 5 is also located in the gas flow pass. A diaphragm operated control valve C having a valve closure member or diaphragm 6 urged by a spring 10 against a valve seat 6A is located subsequent to the aforesaid valve elements and prior to the outlet 2. The spring 10 is located in a chamber 11 beneath the diaphragm 10. The valve structure A is a well-known valve which is sold by the assignee of the present invention and identified as VR8200 Dual Valve Standing Pilot Gas Valve and is described in U.S. Pat. No. 4,543,974 of Dietiker et al which is assigned to the assignee of the present invention.

The valve closure member 6 is ordinarily held against the valve seat 6A by the spring 10 to interrupt the gas flow through the valve C to the outlet 2. This valving action is in series with that provided by the aforesaid electromagnetically controlled armature 4 and solenoid coil 5. Upon an energization of the solenoid coil 5, the armature 4 is actuated to open the associated valve seat 4B and allow an inlet gas from the inlet 1 to enter an internal chamber 7 leading to the valve seat 6A and closure member 6. An outlet port 12 is provided in the chamber 7 and is connected by a gas line 13 having an internal flow control 13A to an inlet of a second electromagnetically controlled valve D having an armature 15 and a solenoid winding 15A. An extension 17 of the armature 15 is connected to a valve closure member 16. The valve closure member 16 is arranged to be operatively associated with a first valve seat 18 in a deenergized state of the winding 15A and a second valve seat 20 in an energized state of the winding 15A.

In the deenergized state of the valve D, the gas flow through the port 12 and the gas pipe 13 is able to enter the space between the valve seats 18,20 and flow out to a second pipeline 24 through a restricted pipe line segment 26 having an internal restriction 28 connected to the space between the valve seats 18,20 or to flow along the armature extension 17 to an unrestricted bypass line 24A which is connected to the gas line 24. The flow of the gas into the gas line 24 is effective to fill the chamber 11 below the valve closure member 6. Thus, a high gas pressure is established on both sides of the valve closure member 6, and the area of exposure to the gas on the underside of the valve closure member 6 is arranged to maintain the valve closure member 6 against the valve seat 6A in combination with the spring 10.

Upon an energization of the winding 15A of the valve D, the armature 15 is actuated to transfer the valve seat closure member 16 from the first valve seat 18 to the second valve seat 20. In this position, the gas flow path through the gas line 24, the restricted pipe segment 26 is directed through the valve seat 18 to allow a gas flow into a gas pipeline 30. The gas pipeline 30 is connected through a gas pressure regulator 32 to a gas pipeline 34, and ultimately, to a port 36 located in the outlet 2 from the gas valve A. This position of the closure member 16 enables the gas beneath the closure member 6 in the chamber 11 to bleed-off through the pipeline 24 and the restriction 28 in pipeline 26 to pipeline 30 leading to the pressure regulator 32. This slow bleeding of the gas from the underside of the valve closure member 6 causes the valve closure member to open slowly in response to the gas pressure exerted on the other side of the valve closure member 6 from the inlet 1. The valve closure member 6 maintains a final position depending upon the calibration of the regulator 32 to provide a desired gas flow from the outlet 2. The purpose of having the valve open slowly is to prevent a puffing or blow back of the gas ignition in a combustion chamber (not shown) supplied by the valve A.

When the valve D is deenergized by a deenergization of the solenoid 15A, the valve closure member 16 is reapplied against the valve seat 18. This position of the valve closure member 16 is effective to open the valve seat 20 which allows the gas entering the port 12 to be conducted through the bypass 24A and the pipeline 24 to the underside of the valve closure member 6. This is effective to rapidly fill the chamber 11 below the valve closure member 6 and close the valve closure member 6 against the valve seat 6A at a fast rate. The purpose of the fast closure is to ensure that valve C is completely closed since should the solenoid 5 in valve B be recycled at a fast rate for a short cycle and if the valve C remains open it would be possible for the inlet gas to enter the appliance combustion chamber through the valve A without ignition to create a potentially explosive gas accumulation.

Figure 2:
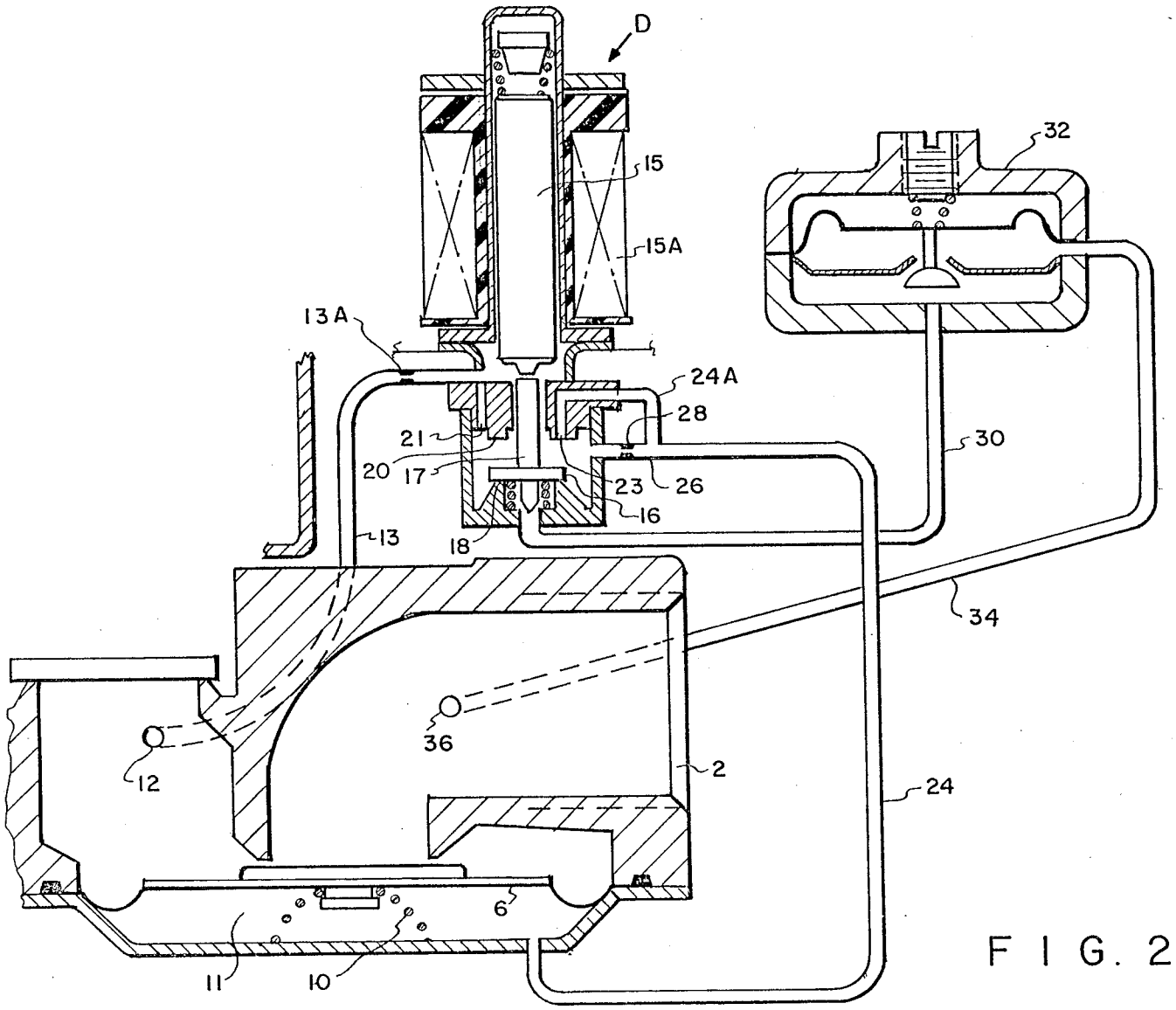
FIG. 2 is a partial cross-section of a gas valve embodying a second example of the present invention and FIG. 3 is a partial cross-section of a gas valve embodying a third example of the present invention.

In FIG. 2, there is shown a partial cross-sectional illustration of a gas valve embodying a second example of the present invention. In this configuration, the port 12 and gas line 13 are connected to an inlet to the electromagnetically controlled valve D which is above the valve seat 20. A internal gas passage 21 in valve D is arranged to connect the line 13 to the space between the valve seat 18,20. Further, the bypass line 24A is connected within the valve D to the valve seat 20 and is arranged to be closed by the closure member 16 when the solenoid 15A is energized. In this arrangement, the gas pressure through line 13 is conducted through gas conduit 21 to fill the chamber 11 through the bypass 22 and the pipeline 24 when the solenoid coil 15A is deenergized. Upon an energization of the solenoid coil 15A, the bypass line 22 is closed by the valve closure member 16 after transfer thereof to the valve seat 23 while the gas from the chamber 11 is allowed to bleed-off through pipeline 24 and pipeline 26 containing the restriction 28 to the pipeline 30 through the open valve seat 18. This enables a slow opening of the valve closure member 6 from the valve seat 6A. Similarly, upon a deenergization of the solenoid coil 15A, the valve closure member 16 is returned to the valve seat 18 to close-off the pipeline 30, and the gas from the port 12 and pipeline 13 is allowed to pass through the conduit 21, the bypass 22 and the pipeline 24 to quickly fill the chamber 11 and urge a fast closure of the valve closure member 6 against the valve seat 6A. Thus, this structure is also effective to provide slow opening and fast closure operations of the valve structure.

Figure 3:
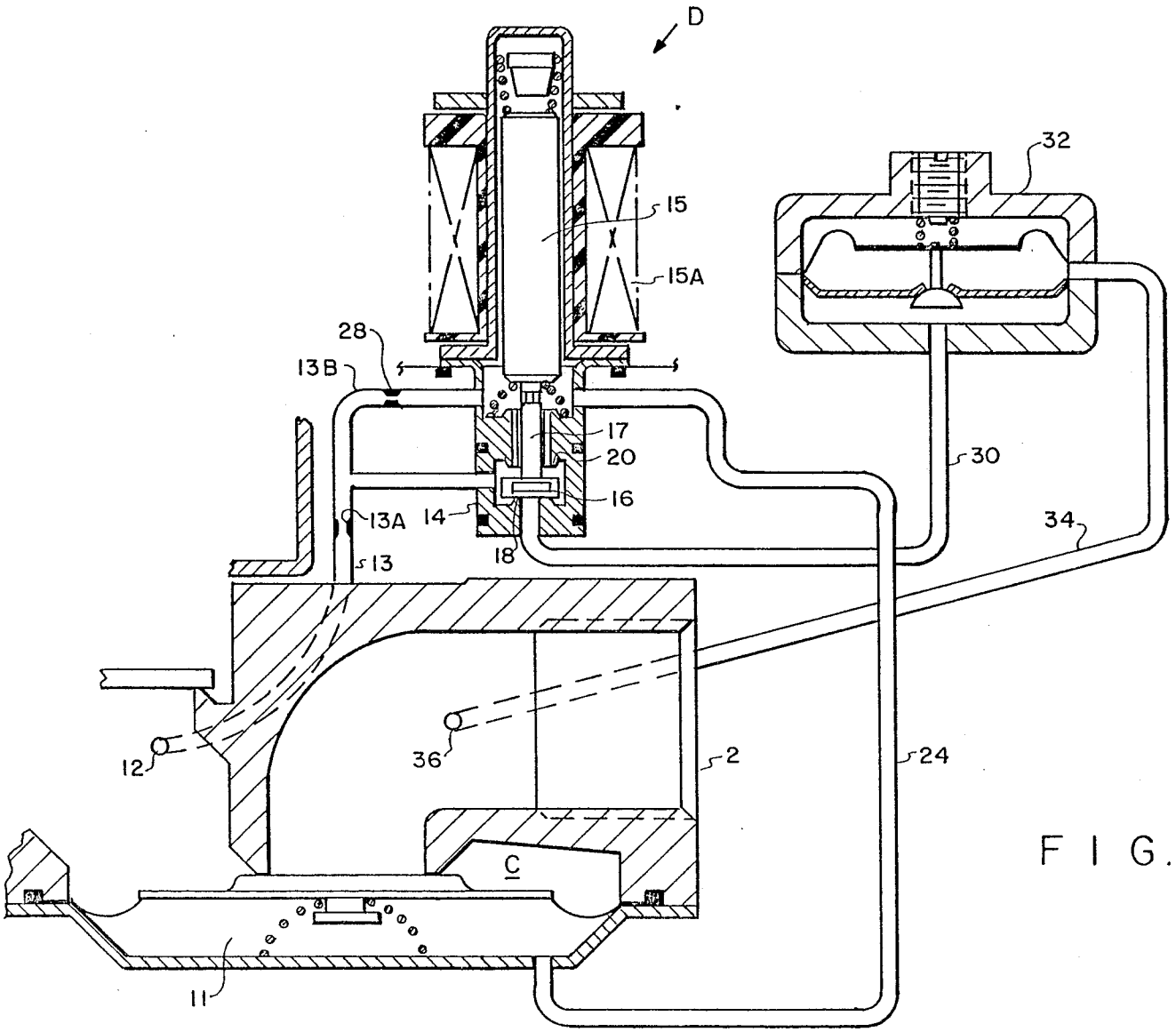

In FIG. 3, there is shown a partial cross-sectional illustration of a third example of the present invention wherein the pipeline 13 which is connected to one side of the valve seat 20 as shown in FIG. 1 is also connected by an added bypass line 13B to the other side of the valve seat 20 past the armature 17. The bypass line 13B has the internal restriction 28 therein and connects to the pipe line 13 after the flow control element 13A, i.e., on the valve D side of the element 13A. Further, the armature 17 is provided with a plurality of surface grooves to enable a gas flow to be established therethrough. Further, the pipeline 24 is connected only to the same side of valve seat 20 as the bypass line 13B. Thus, in this arrangement, the unenergized position of the valve closure member 16 allows a gas flow through the bypass 13A, past the valve seat 20 and the grooves around the armature extension 17 to produce a fast closure of the valve C by quickly filling the chamber 11. Upon an energization of the coil 15A of the valve D, the valve closure member 16 is transferred from the first valve seat 16 to the second valve seat 20. In this position, the gas flow path from the gas line 24 is through the bypass line 13B and the restriction 28 to the pipeline 13 and, ultimately, past the valve seat 18 to pipeline 30 to the regulator 32 and the pipeline 34 leading to the exit port 36. This allows a slow bleed-off of the pressure in the chamber 11 which causes the valve C to open slowly in response to the inlet gas pressure. Accordingly, the embodiment shown in FIG. 3 also provides slow opening and fast closure operations of the valve.

Accordingly, it may seen, that there has been provided, in accordance with the present invention, an improved gas valve having separately characterized opening and closing rates.

The embodiments of the present invention in which an exclusive property or privilege is claimed are defined as follows:

1. A valve comprising a valve seat, a valve closure member facing said valve seat, first flow path means for providing an operation of rapidly admitting a pressurized gas to urge the member against the seat, a second flow path means having a fixed flow restriction and control means for blocking the operation of said first flow path means and introducing said second flow path means as an exit path for the pressurized gas through said restriction to interrupt the urging of said valve closure member against said valve seat by the pressurized gas by allowing the pressurized gas to slowly exit through said fixed restriction, wherein said control means includes a valve having a first outlet connected to said first flow path means, a second outlet connected to said second flow path means, a first inlet connected to a source of the pressurized gas, a third gas exit outlet and valve flow path control means for selectively and alternately connecting said first inlet to said first outlet and said second outlet to said third gas exit outlet.

2. A valve as set forth in claim 1 and further including a spring for urging said member against said seat.

3. A valve comprising a valve seat, a valve closure member facing said valve seat, first flow path means for providing an operation of rapidly admitting a pressurized gas to urge the member against the seat, a second flow path means having a fixed flow restriction and control means for blocking the operation of said first flow path means and introducing said second flow path means as an exit path for the pressurized gas through said restriction to interrupt the urging of said valve closure member against said valve seat by the pressurized gas by allowing the pressurized gas to slowly exit through said fixed restriction, wherein said control means includes a valve having a first outlet connected to said first flow path means, a second outlet connected to said second flow path means, a first inlet connected to said valve inlet means, a third gas exit outlet and valve flow path control means for selectively and alternately connecting said first inlet to said first outlet and said second outlet to said third gas exit outlet, and further including a valve inlet means arranged to be connected to the source of the pressurized gas permitting the pressurized gas to said first flow path means and concurrently to urge said valve closure member away from said valve seat.

4. A valve as set forth in claim 3 wherein said valve flow path control means includes a second valve seat, a third valve seat, a second closure member, a third closure member and selectively energizable means for alternately positioning said second closure member against said second valve seat and said third closure member against said third valve seat.

5. A valve as set forth in claim 3 and further including a spring for urging said member against said seat.

* * * * *